US007350876B2

(12) United States Patent
Burgess et al.

(10) Patent No.: US 7,350,876 B2
(45) Date of Patent: Apr. 1, 2008

(54) COMBINATION PANLINE AND UTILITY DRILLING OR BOLTING UNIT

(75) Inventors: Timothy D. Burgess, South Point, OH (US); William G. Kendall, Jr., Spanish Fork, UT (US); David L. Morris, Huntington, WV (US); Steven Payne, Portsmouth, OH (US)

(73) Assignee: J.H. Fletcher & Co., Huntington, WV (US)

( * ) Notice: Subject to any disclaimer, the term of this patent is extended or adjusted under 35 U.S.C. 154(b) by 9 days.

(21) Appl. No.: 10/949,981

(22) Filed: Sep. 24, 2004

(65) Prior Publication Data

US 2005/0067879 A1 Mar. 31, 2005

Related U.S. Application Data

(60) Provisional application No. 60/578,160, filed on Jun. 9, 2004, provisional application No. 60/507,322, filed on Sep. 30, 2003.

(51) Int. Cl.
*E21D 20/00* (2006.01)

(52) U.S. Cl. ..... 299/95

(58) Field of Classification Search ..... 299/10, 299/95

See application file for complete search history.

(56) References Cited

U.S. PATENT DOCUMENTS 4,240,665 A * 12/1980 Hubbard et al. ..... 299/31
4,448,263 A 5/1984 Becker et al.
5,413,154 A * 5/1995 Hurst et al. ..... 141/83
5,925,816 A * 7/1999 Kovacs ..... 73/40
6,109,700 A 8/2000 Branson et al.
6,149,373 A * 11/2000 Gesuale ..... 414/607
6,230,363 B1 * 5/2001 Kawai et al. ..... 15/339
6,364,148 B1 * 4/2002 Neilson et al. ..... 220/553

FOREIGN PATENT DOCUMENTS

DE 2260037 * 6/1974
DE 3437401 A1 * 8/1985
GB 2177033 A * 1/1987
JP 406123194 A * 5/1994

OTHER PUBLICATIONS

"Bolting Up" Potts, Adriana; World Mining Equipment, Jun. 1999.*
"2RFB-1 ARO: Hydramatic Engineering—Rapid Face Bolter for Longwalls" □□Brochure, received in USPTO Dec. 1999.*

* cited by examiner

*Primary Examiner*—John Kreck
(74) *Attorney, Agent, or Firm*—King & Schickli, PLLC

(57) ABSTRACT

A drilling or bolting unit for selective use with either a vehicle or a panline of a face conveyor associated with a longwall miner or mining machine is disclosed. In one embodiment, the unit comprises a base adapted for engaging the panline and a plurality of receivers. Each receiver may be adapted for receiving one of the pair of forks of the vehicle, such that the unit may be used as either a panline drilling or bolting unit or as a utility drilling or bolting unit with the vehicle apart from the panline. Related methods are also described.

24 Claims, 10 Drawing Sheets

COMBINATION PANLINE AND UTILITY DRILLING OR BOLTING UNIT

This application claims the benefit of U.S. Provisional Patent Application Ser. Nos. 60/507,322 filed Sep. 30, 2003 and 60/578,160, filed Jun. 9, 2004 which are fully incorporated herein by reference.

TECHNICAL FIELD

The present invention relates to underground mining and, more particularly, to a drilling and/or bolting unit adapted for use either with a panline or a utility vehicle.

BACKGROUND OF THE INVENTION

In underground longwall mining, a plurality of pans are connected in an end-to-end, modular relationship to form a "face" conveyor for handling the mined minerals, such as coal. In addition to receiving the minerals won from the working face and guiding flights that convey the minerals away, the mating pans (collectively referred to as a "panline") also serve as a guide track for the cutter/shearer as it reciprocates back and forth along the face. Using a system of rams or similar motive devices, the panline is continuously advanced forward in a sequential fashion as the cuts are made.

Typically, temporary hydraulic roof supports known as shields move along with and protect the shearer and face conveyor (collectively referred to as the longwall "miner" or "mining machine"). As these shields advance, the roof is usually allowed to collapse behind the miner. The exception is during the last few passes of the shearer, where the shields are not advanced in order to create a sufficiently large passageway to facilitate the time-consuming disassembly and relocation of the longwall miner. As a result, a relatively large area of unsupported roof may exist between the shields and the working face.

In this situation, it is desirable and in fact required by law to install a more permanent type of support at certain specified locations along the unsupported roof and ribs of the mine passage in an effort to prevent a deleterious collapse. Typically, the most efficient manner of providing such support involves using what is known in the vernacular as a "roof" bolt (even though it is equally effective in the "ribs" of the mine passage as well). In the usual case, the bolt comprises an elongated piece of metal (such as rebar) inserted in a borehole drilled in the corresponding face and held in place by a previously introduced quick-setting resin. The installed bolt thus anchors the exposed strata (usually the next-adjacent one) and provides the desired support for at least a portion of the adjacent face.

To meet the need for providing support for the roof adjacent to the working face, others in the past have proposed a special type of drilling/bolting unit for use in association with the panline of the face conveyor. This unit is adapted for traversing to and fro along the panline and carries an operator who installs the bolts along the newly formed roof and/or ribs using an onboard drill mast. One example of such a unit is found in U.S. Pat. No. 6,109,700 to Branson et al., the disclosure of which is incorporated herein by reference. The advantage of such a unit is that it dispenses with the need for moving a separate bolting machine (which is typically a relatively large vehicle on wheels or crawler tracks) into the confined space between the shields and the working face.

Although this type of unit works well for its intended purpose, it experiences a significant amount of downtime while the shearing operation progresses and the panline concomitantly advances toward the face during the longwall operation. During this period of non-use, other locations in the mine (including those where conventional (i.e., non-longwall) mining takes place) could benefit from the use of an extra or "utility" drilling/bolting unit. However, past panline drilling/bolting units, including the modern version shown in the '700 patent, have deleteriously not been adapted for use apart from the panline. Consequently, the mine operator must purchase a separate non-panline type drilling/bolting vehicle for drilling/bolting at remote locations while the panline unit sits dormant. This obviously increases not only the capital investment, but also the operating and maintenance costs associated with the mining operation. The end result is either higher market prices for the won minerals (which can be problematic in the highly competitive marketplace) or a decrease in profit for the mining operator.

Accordingly, a need is identified for a panline drilling or bolting unit adapted for use elsewhere in an underground mine and apart from the face conveyor.

SUMMARY OF THE INVENTION

In accordance with one aspect of the invention, a drill unit for selective use with either a vehicle or a panline of a face conveyor associated with a longwall miner or mining machine is disclosed. The unit comprises a base adapted for engaging the panline and means associated with the base for engaging the vehicle.

In one embodiment, the means for engaging comprises first and second spaced receivers, each for receiving a fork associated with the vehicle. Additionally or alternatively, the means for engaging may comprise third and fourth spaced receivers oriented in a direction generally perpendicular to the first and second spaced receivers. Preferably, one of the receivers comprises a pair of retractable pockets adapted for receiving one of the forks associated with the vehicle in an actuated position. In the actuated position, the pockets generally align with a conveying direction of the panline.

In the typical longwall installation, the panline includes a shearer or cutter mechanism driven to and fro therealong. The possibility exists for using a tow bar for associating the base with the shearer or cutter to move the unit to and fro. Alternatively, the unit may be self-propelled with the assistance of an onboard motor, preferably of the hydraulic type. The motor through a sprocket may associate with the existing trapping shoe associated with the longwall miner.

In accordance with a second aspect of the invention, the combination of a vehicle and a drilling or bolting unit adapted for engaging a panline of a face conveyor is disclosed. The unit includes a plurality of receivers, each adapted for receiving a part of the vehicle. As a result of this arrangement, the unit may be used as either a panline drilling or bolting unit or a utility drilling or bolting unit with the vehicle apart from the panline.

Preferably, two receivers are provided, each having a direction of elongation generally perpendicular to the conveying direction of the panline when associated therewith. Alternatively, each receiver may have a direction of elongation generally parallel to the conveying direction of the panline when associated therewith. In one particular embodiment, the plurality of receivers includes four receivers, with two of the four receivers having a direction of elongation generally perpendicular to the conveying direction of the panline when associated therewith, and the other two receivers having a direction of elongation generally parallel to the conveying direction of the panline when associated therewith.

One of the receivers may include a pair of pockets movable between a stowed or retracted position and an actuated position for receiving the part of the vehicle. Preferably, the pockets are pivotally mounted to a base of the unit. Fasteners or latches are provided for securely holding the pockets in the retracted position.

In accordance with a third aspect of the invention, a method of drilling in an underground mine having a longwall miner or mining machine including a panline is disclosed. The method comprises: (a) associating a drill unit with the panline; (b) drilling a borehole adjacent the panline using the drill unit associated with the panline; (c) associating the drill unit with a vehicle; and (d) using the drill unit associated with the vehicle.

In one embodiment, the drill unit includes a base and the step of associating the drill unit with the panline comprises placing the base in contact with an upper surface of the panline. Also, the vehicle includes a pair of forks, and the step of associating the drill unit with the vehicle comprises inserting each fork in a corresponding receiver provided in the drill unit. The method may further include the step of moving each receiver from a stowed position before inserting the corresponding fork. Preferably, steps (a) and (b) are performed before steps (c) and (d), and steps (a) and (b) are repeated after steps (c) and (d) are performed.

The step of associating the drill unit with the panline may comprise connecting the drill unit to a source of pressurized hydraulic fluid associated with the panline. Likewise, the step of associating the drill unit with the vehicle may comprise connecting the drill unit to a source of pressurized hydraulic fluid associated with the vehicle. As a result, the step of using the drill unit in association with the vehicle may comprise moving the vehicle to a location remote from the panline without concern for the hydraulic source associated therewith.

In accordance with a fourth aspect of the invention, a drilling or bolting unit adapted for engaging a panline of a face conveyor is provided. The unit includes a plurality of receivers, each adapted for receiving one of the pair of forks of a vehicle. As a result, the unit may be used as either a panline drilling or bolting unit or a utility drilling or bolting unit with the vehicle apart from the panline.

In accordance with a fifth aspect of the invention, a drilling or bolting unit is disclosed. The unit comprises means for engaging a panline of a face conveyor. The unit further comprises means for engaging a vehicle apart from the panline.

In one embodiment, the means for engaging the panline comprises a plurality of shoes and at least one tongue for engaging a trapping shoe associated with the panline. The means for engaging the vehicle comprises at least one pair of receivers, each receiver of the pair adapted for receiving an elongated lifting structure associated with the vehicle. Preferably, at least one of the receivers comprises a pair of pockets movable between a stowed or retracted position and an actuated position.

In accordance with a sixth aspect of the invention, a drilling or bolting unit for use in association with a guide rail of a panline forming part of a face conveyor is disclosed. The panline includes a trapping shoe, and the unit comprises a base supporting a drill or bolter and at least one transverse receiver associated with the base and adapted for receiving a removable retainer for associating with the trapping shoe.

In accordance with a seventh aspect of the invention, a method of associating a drilling or bolting unit with a panline of a face conveyor is disclosed. The method comprises placing the unit on the panline without first removing a section of the panline and associating a trapping shoe with both the pan line and the unit to provide a holddown function.

The associating step includes inserting at least a portion of the trapping shoe or an extension thereof within a transverse receiver forming part of the drilling unit. Preferably, the placing step is completed before the associating step.

DETAILED DESCRIPTION OF THE INVENTION

Reference is first made to FIGS. 1-5, which are perspective top, side, and end views of a combined panline and utility drilling/bolting unit 10 constructed in accordance with one embodiment of the present invention. In the illustrated embodiment, the unit 10 includes a base 12 adapted for engaging and riding along an upper section or trough of a panline P (which arrangement advantageously avoids the need for removing a pan section to install the unit 10, as noted in more detail in the description that follows). Specifically, the base 12 includes means for engaging the panline P. The engaging means may comprise the generally flat underside surfaces of shoes 14 connected to the base 12 and adapted for riding along the upper surface of the spaced, generally parallel sidewalls S of the upper trough of the panline P (which typically has a sigma-shaped cross-section; see FIG. 1). Trapping and/or guide shoes 16, 17 may also be used for engaging and receiving an elongated guide rail G associated with the panline P (see FIGS. 4 and 5). Through this engagement, the shoes 16, 17 both help to guide the unit 10 and provide a hold-down function as it moves to and fro along the panline P.

Figure 6C:
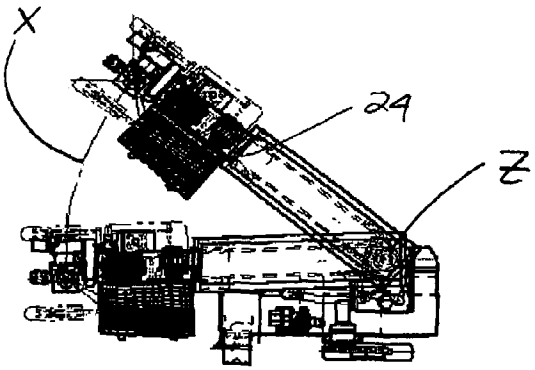
FIG. 6*c* is a top view of the unit of FIG. 6*a;*

In the illustrated embodiment, the base 12 supports a swingable boom 18, which in turn supports the drill 20. The boom 18 is mounted for pivoting about at least two axes (note horizontal plane pivot point Z and swing axis X in FIG. 6*c*, as well as vertical plane pivot point Y in FIG. 2). The drill 20 may be of any conventional type for forming a borehole in the face of a mine passage (typically the roof, but possible the working face or the like). The typical type of drill 20 used in the underground environment for forming a small diameter borehole for receiving a roof anchor or bolt usually includes a telescoping linear slider mast 21 supporting a rotary drillhead 22 (see FIGS. 6*a*-6*c* and 7*a*-7*b*). Although a boom 18 is preferred due to the enhanced range of movement created, it is considered optional. Indeed, the unit 10 could simply include a drill/bolter mounted directly to the base 18, similar to what is shown in U.S. Pat. No. 6,109,700.

Turning to FIGS. 6-7, completing the drilling operation involves inserting a drill steel or rod in the chuck (not shown) of the drillhead 22 and advancing it toward the corresponding face of the passage by the mast 21 to form the borehole. The drill steel is then withdrawn by retracting the drillhead 22, which then may be used to install the bolt into the hole (usually after a resin cartridge is inserted). The distal end of the mast 21 may include a guide 23 for holding and guiding the drill steel or bolt as it advances toward the corresponding face.

The boom 18 also carries a platform 24 adjacent to the drill 20 for supporting an operator. To protect the operator from falling debris, a canopy 26 may be provided over the platform 24. In the most preferred embodiment, the canopy 26 forms part of an automated temporary roof support (ATRS) system that includes a hydraulic jack 28 for raising and lowering the canopy 26 into engagement with the adjacent roof. A corresponding extensible support cylinder 30 is also provided for engaging the ground to stabilize the platform 24 during the drilling sequence. The platform 24 may also support the controls 32 for the drill 20, the ATRS system, and the tramming of the unit 10 along the panline P. A tray 34 adjacent to the operator's platform 24, such as on the upper surface of the boom 18, may be provided for keeping the drill steels, bolts, and like supplies within reach. Moreover, the end of the boom 18 may attach to a saddle 35, as shown in FIG. 6*b*. The saddle 35 provides structure to which the operator's platform, ground support cylinder, and canopy/TRS and drill may attach.

Figure 6A:
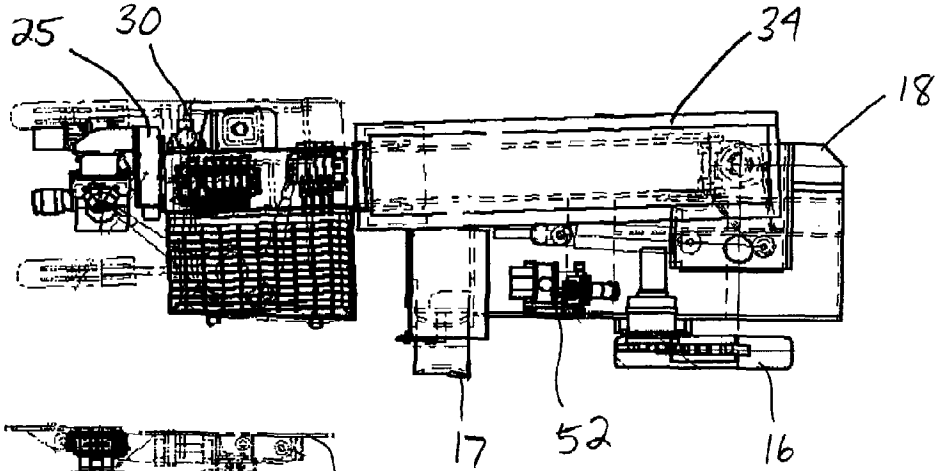
FIG. 6*a* is a top view of a drilling/bolting unit including a drill associated with a boom.
Figure 6B:
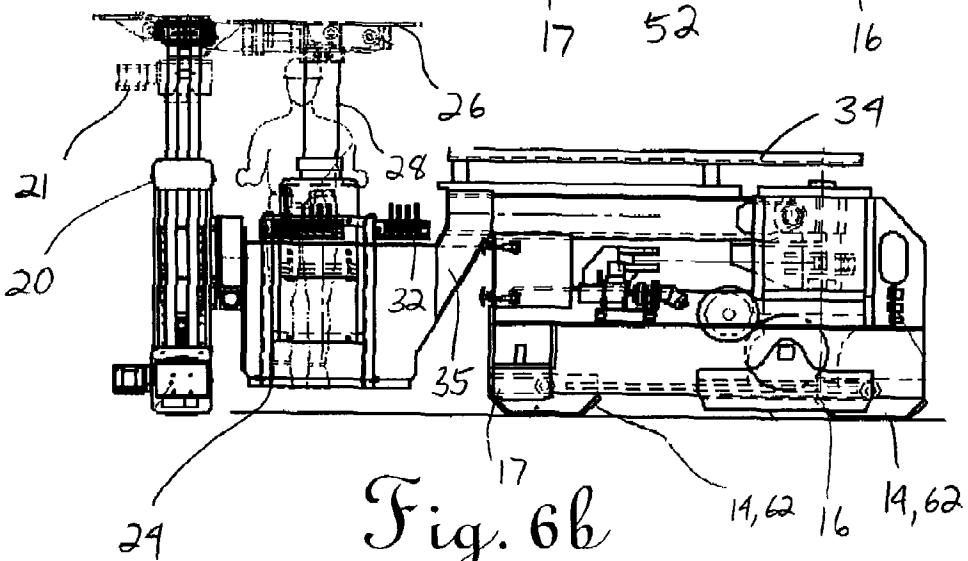
FIG. 6*b* is a side view of the unit of FIG. 6*a;*
Figure 7B:
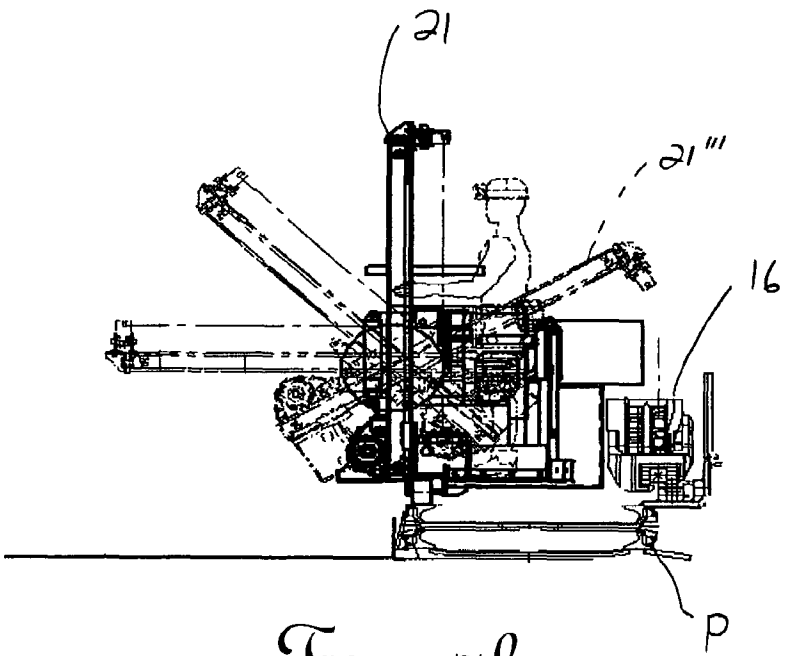
FIG. 7*b* is a view similar to FIG. 7*a*, showing in particular the pivoting of the drill mast to a stowed position.
Figure 7A:
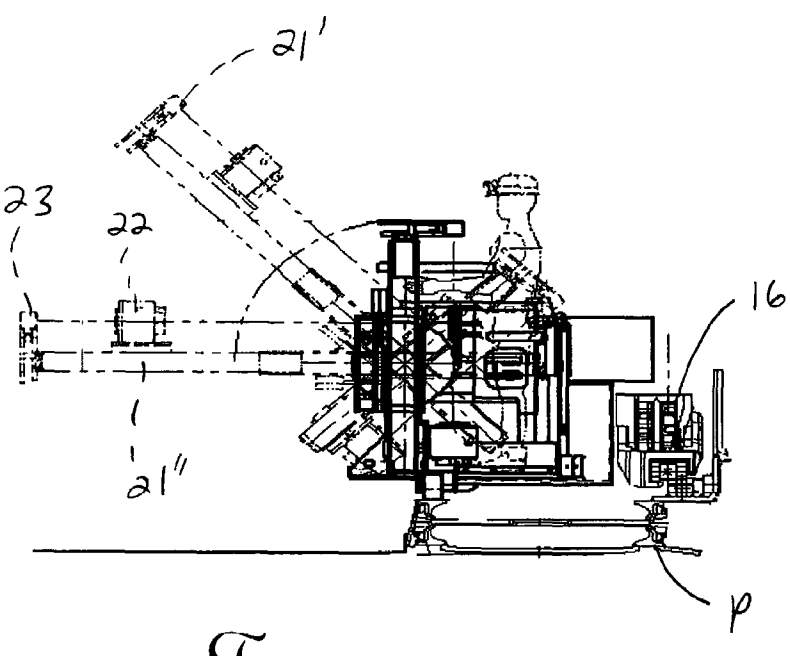
FIG. 7*a* is a side view showing the pivoting of the drill mast relative to the base on the unit on the panline.

As shown in FIG. 6*a*, the mast 21 is preferably mounted to the platform 24 so as to be capable of pivoting through a relatively wide range of angles. Specifically, the mast 21 is associated with a tilt box 25 having a worm gear arrangement (not shown) that may be used to rotate it among a variety of operational positions. For example, as shown in FIGS. 7*a* and 7*b*, the mast 21 may be rotated from a vertical position to an intermediate position (21') for drilling a borehole or installing a corresponding bolt at an angle to the vertical plane. Further tilting orients the mast 21 such that the longitudinal axis thereof is generally parallel to a horizontal plane (position 21"), such as may be necessary or desired for drilling a borehole and installing a bolt in a vertical face or rib of the mine passage. The mast 21 is also capable of rotating in the opposite direction to a stowed position (21''') (either 45° or 60°) for transport. The total range of pivoting movement is preferably on the order of about 180°.

To move the unit 10 along the panline P to a desired location for performing a bolting or drilling operation, it may simply be connected via a tow bar (not shown) to the self-propelled shearer or cutter (not shown). The unit 10 is then pulled or pushed along by the shearer or cutter as it moves along the guide track G in a corresponding direction (either as the result of engagement between a driven sprocket and a guide rail or a chain pulled along the panline P). When the unit 10 is stopped at the locations where support is desired, the operator may manipulate the boom 18 using the controls 32 to move the platform 24 to the appropriate location for performing the drilling/bolting operation.

To provide power for the onboard devices, such as the boom 18 and drill 20, the unit 10 may be coupled directly to the hydraulics of the longwall machine (which may include elongated, "main" hoses (not shown) extending through a trough T formed along the rear of the panline P adjacent the wall W and coupled to a remote source of pressurized hydraulic fluid) or the shield. Alternatively, an onboard power supply (fluid, electric, or both) may be provided for this purpose (not shown), but this will increase the size and weight of the resulting machine.

Figure 2A:
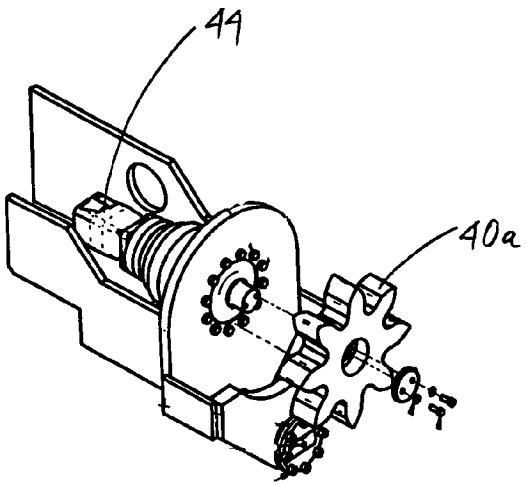
FIG. 2*a* is a partially exploded perspective view of the onboard drive for the drilling/bolting unit.
Figure 2:
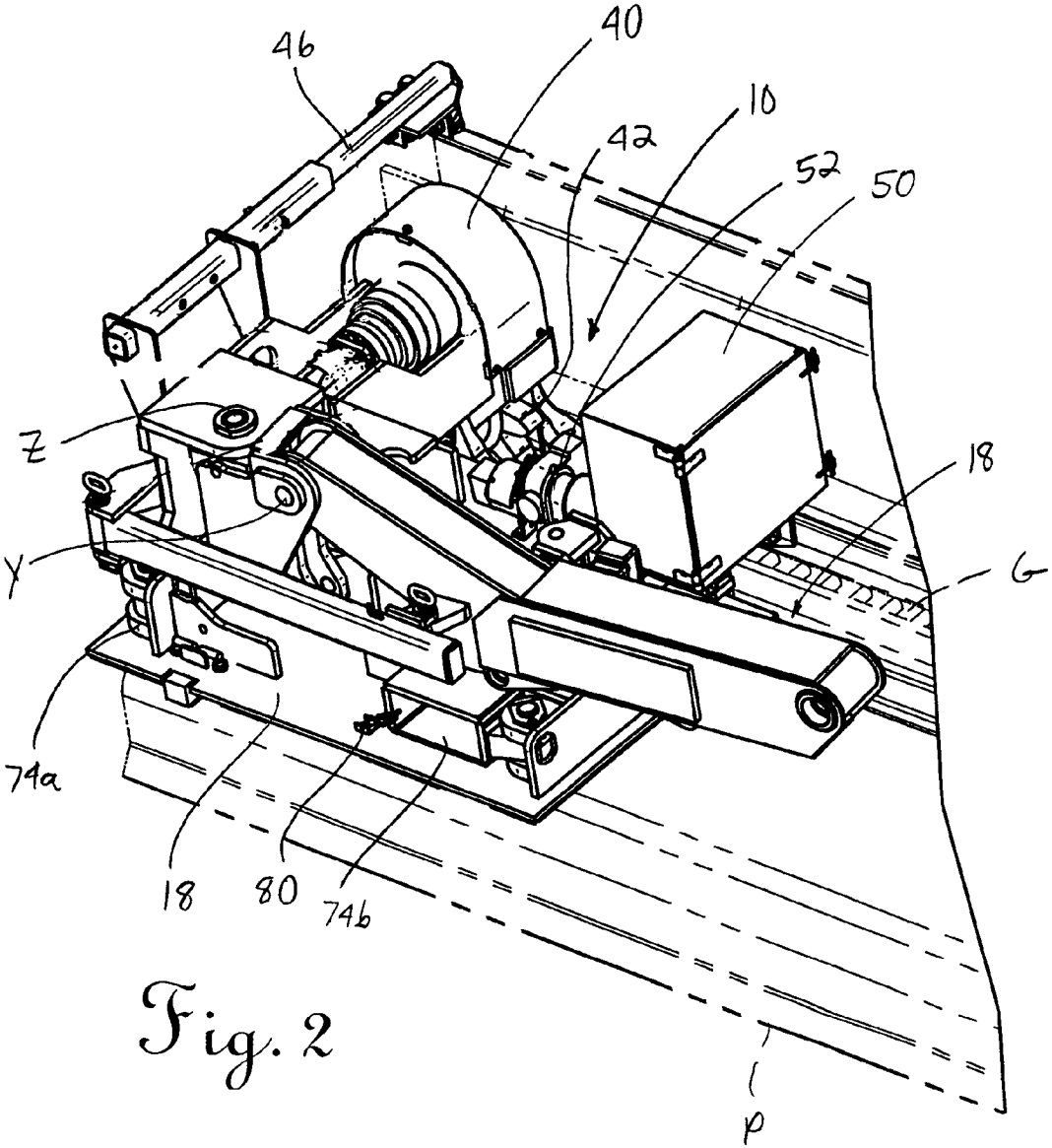
FIG. 2 is a different perspective view of the drilling/bolting unit of FIG. 1.
Figure 3:
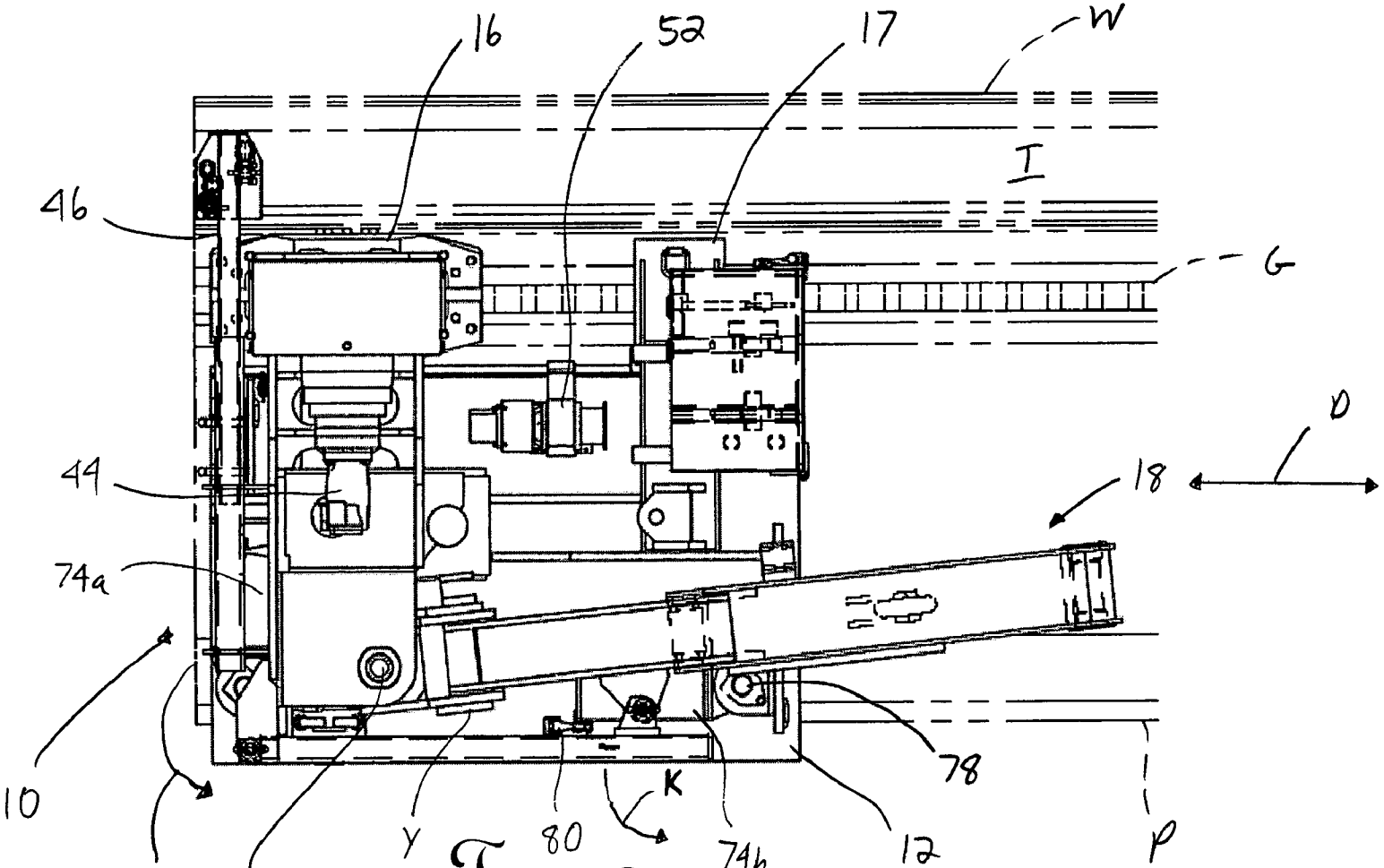
FIG. 3 is a top plan view of the drilling/bolting unit of FIG. 1.

Instead of slaving the unit 10 to the shearer/cutter, an onboard drive 40 may be provided for independently tramming the unit along the panline P. As perhaps best shown in FIG. 2*a*, the drive 40 may include a rotatable drive sprocket 40*a* mounted adjacent to the rear end of the base 12. The sprocket 40*a* is adapted for engaging a second, rotatably mounted sprocket or pinion 42 associated with the trapping shoe 16 on the guide rail G. When the pinion 42 is rotated, the teeth enter the gaps in the ladder-like rack or guide rail G formed along the panline P and move the unit 10 along in a corresponding direction. As should be appreciated by those of skill in the art, this guide rail G is typically the same structure used to propel the shearer or cutter along the panline P using a similar drive arrangement. The sprocket 42 may be driven by an onboard reversible hydraulic motor 44 (see FIG. 3), and may be associated with the hydraulics of the longwall machine (including the cutter or shearer) or shield. Instead, as noted above, an onboard source of pressurized fluid or electricity may provide power for not only tramming the unit 10, but also for the boom 18 and drill 20/mast 21.

In cases where the unit 10 relies on the hydraulics typically associated with the panline P, a mast 46 includes connectors adapted for receiving the delivery end of the main hoses at one end. Auxiliary hoses (not shown) deliver the fluid from the main hoses to the motor 44 and any on board devices dependent on the fluid for power. Preferably, the mast 46 is tubular and capable of telescoping toward and away from the wall W adjacent the panline P to permit adjustments to be made for use with different types of face conveyors. Telescoping the mast 46 also may be done to reduce the overall dimensions of the unit 10 to facilitate moving or transporting it to another location.

The unit 10 may also carry a dust collection system 50 associated with the drill 20 for collecting the dust and/or cuttings that result from the drilling operation. The dust collection system may be of the vacuum type, and a corresponding blower 52 is provided on the base 18 for creating the negative pressure for drawing the bailing fluid (e.g., air) through the drill steel. The blower 52 may be powered in the same manner as the drill 20.

Figure 1:
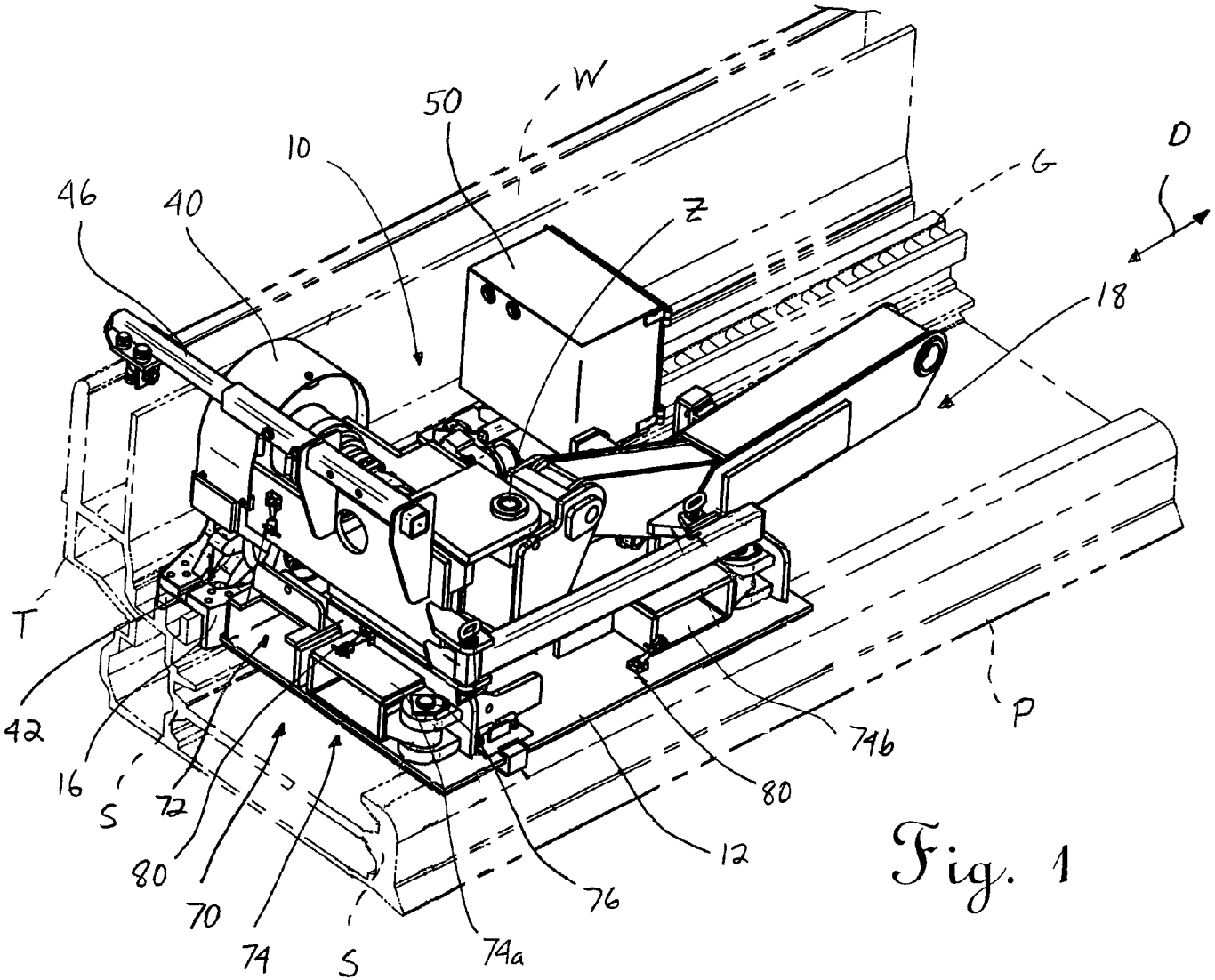
FIG. 1 is a perspective view of one embodiment of a combination panline and utility drilling/bolting unit positioned on a panline in a longwall mining operation, but shown without the drill or bolter.
Figure 4:
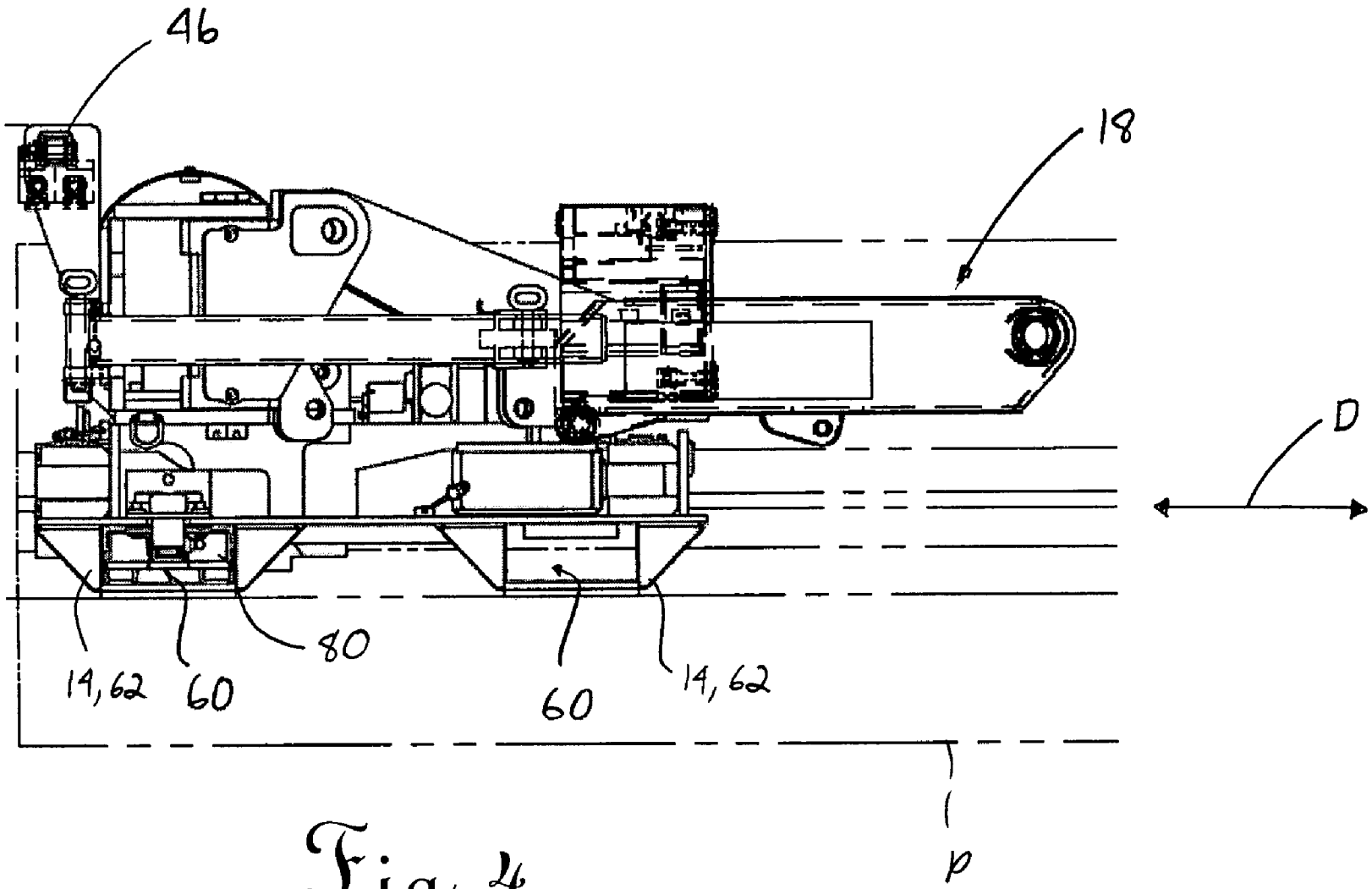
FIG. 4 is a side view of the drilling/bolting unit of FIG. 1.
Figure 5:
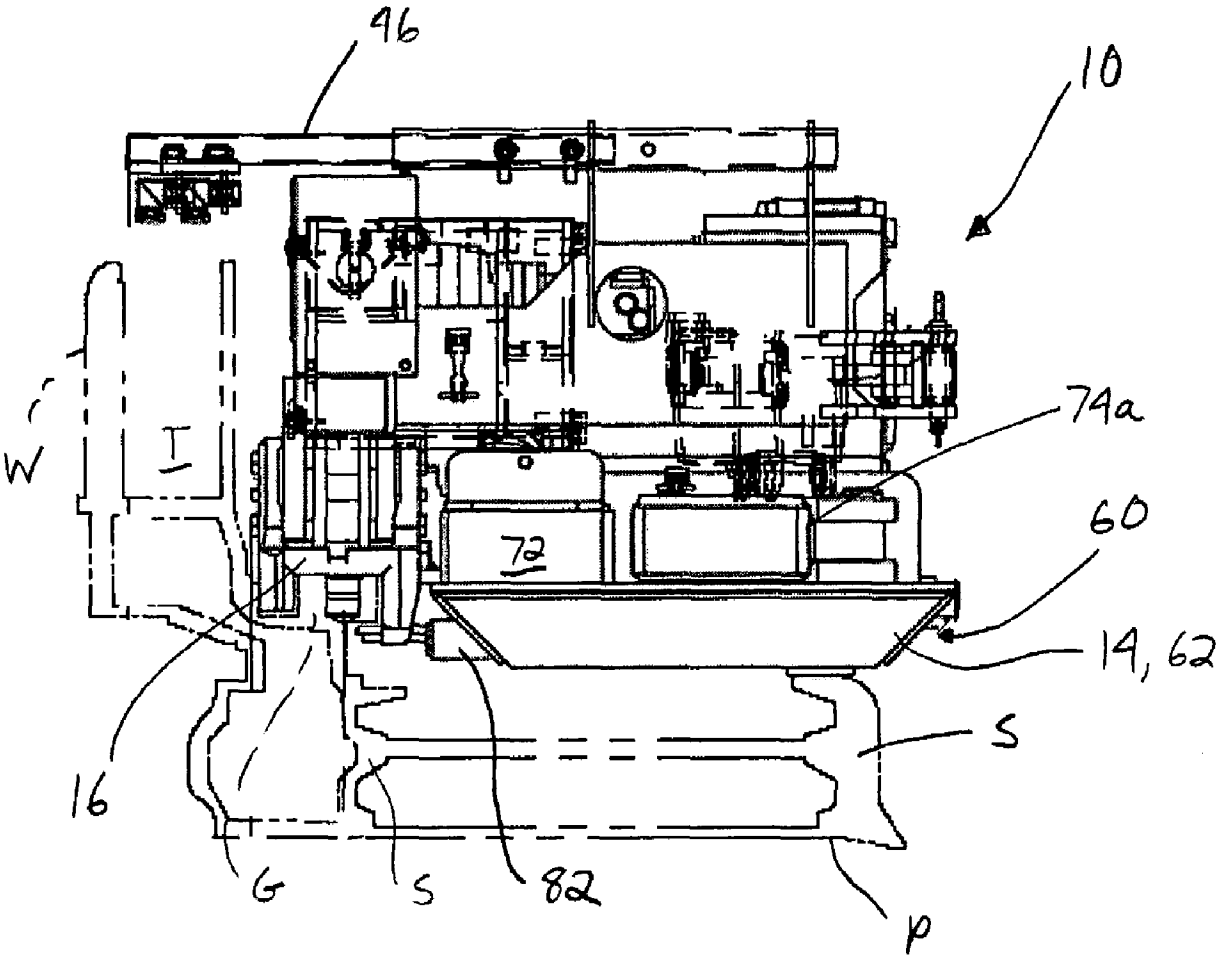
FIG. 5 is an end view of the drilling/bolting unit of FIG. 1.
Figure 8A:
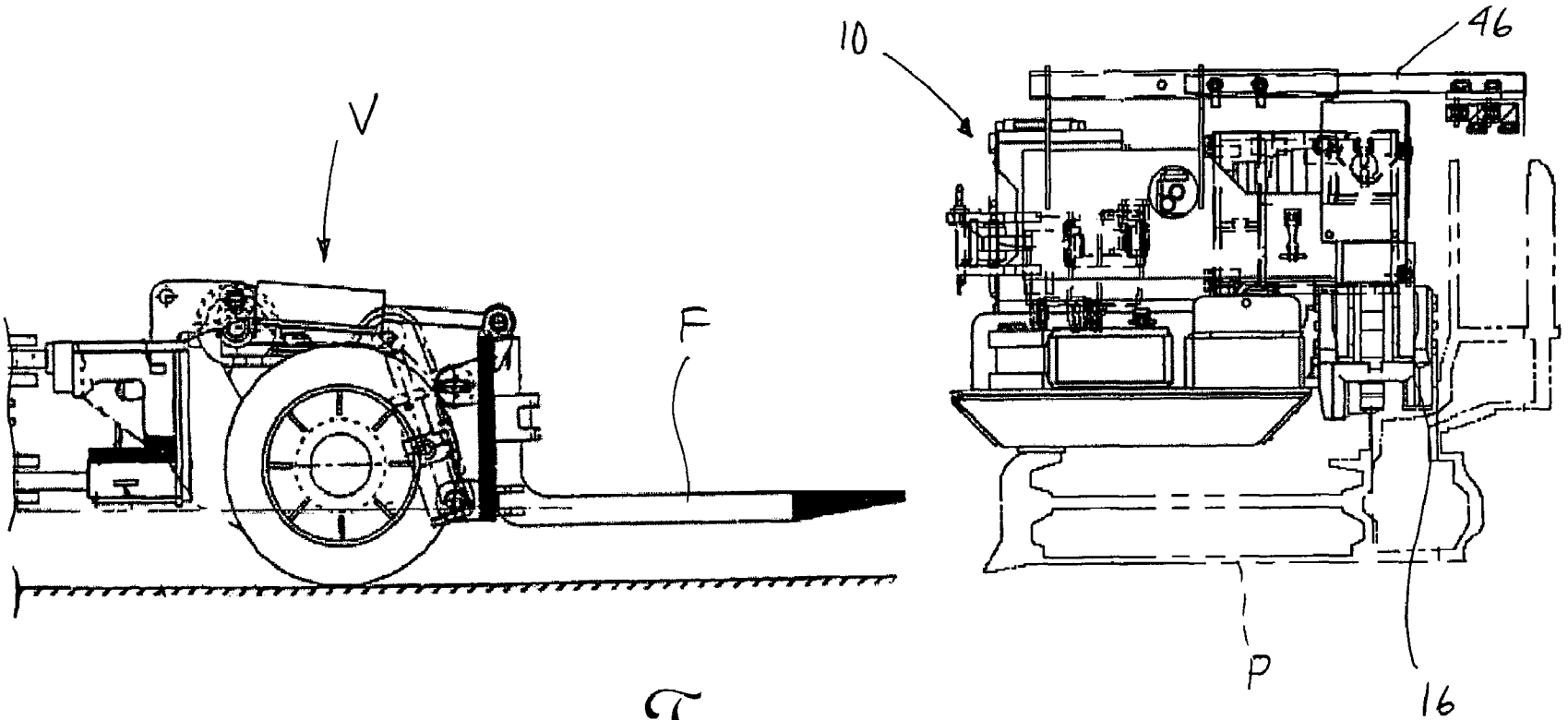
FIG. 8*a* is a side view showing a vehicle, such as a shield hauler, and the drilling/bolting unit positioned on the panline of a longwall conveyor.
Figure 8B:
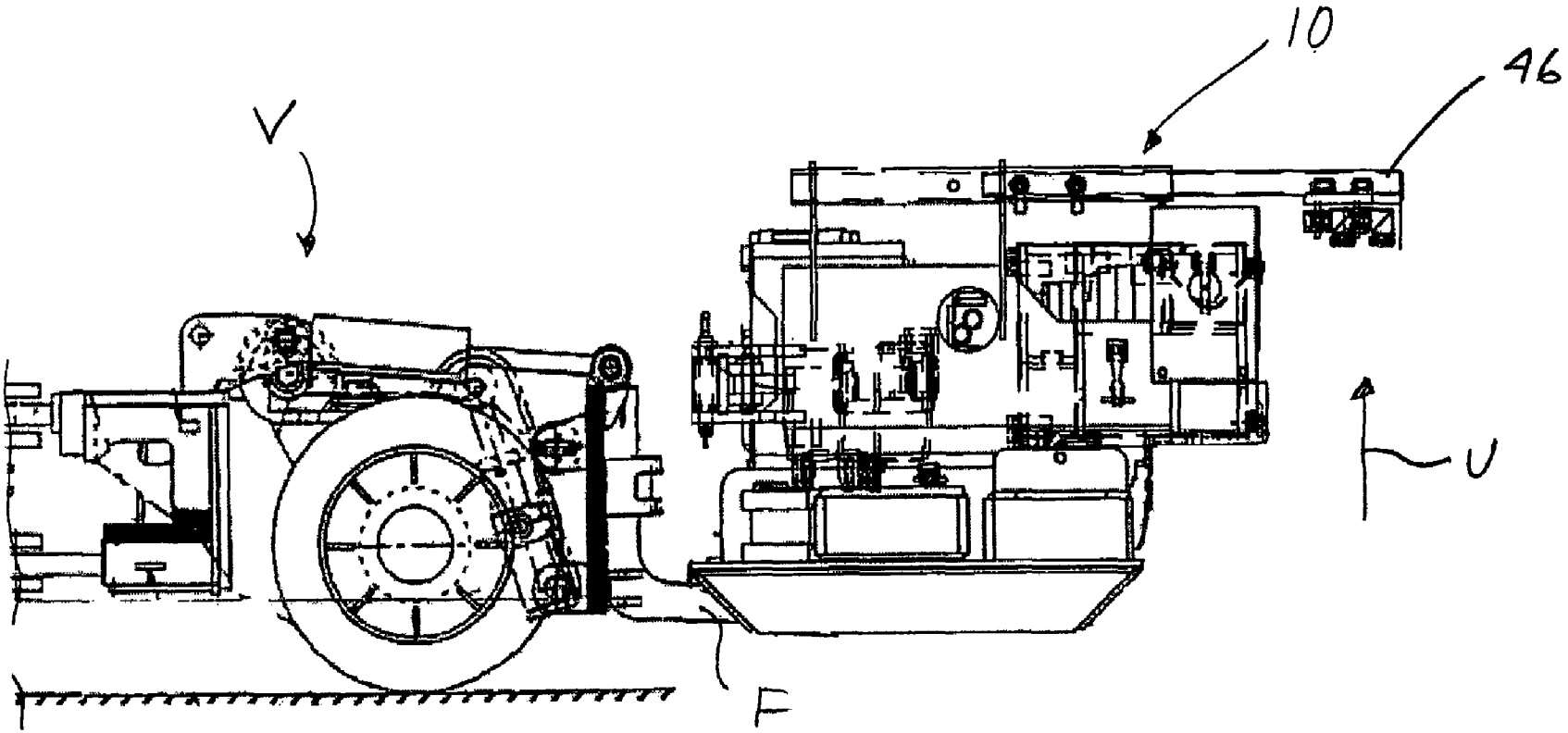
FIG. 8*b* shows from the side the vehicle lifting the drilling/bolting unit apart from the conveyor panline.
Figure 9:
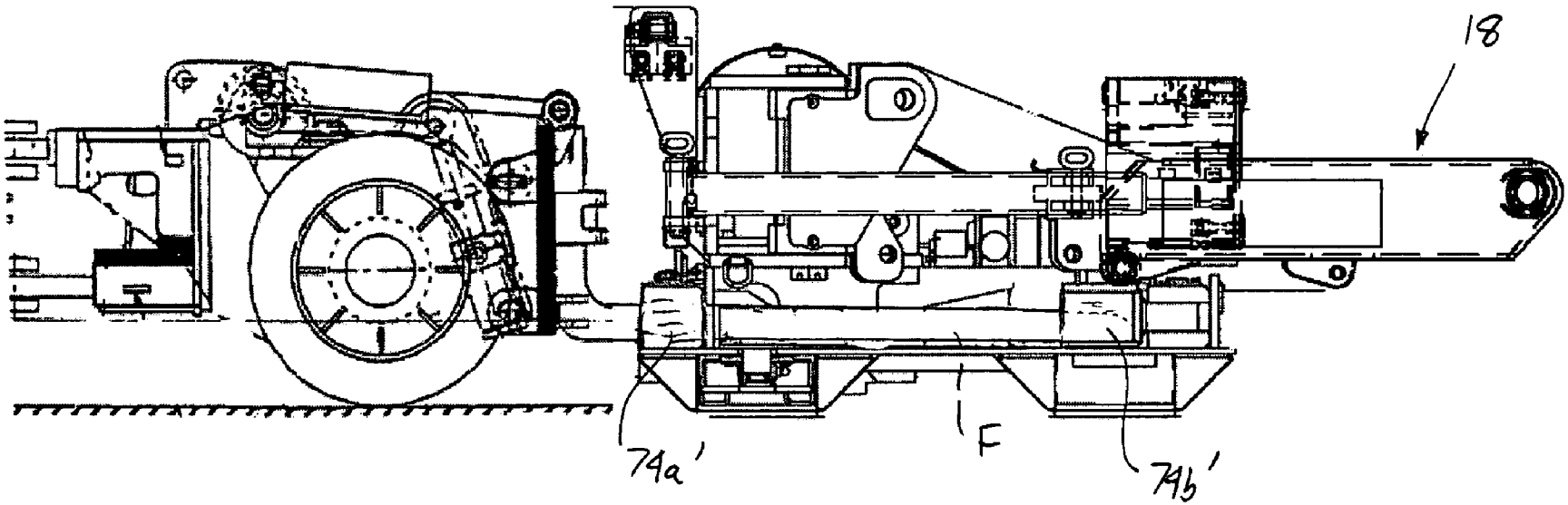
FIG. 9 is a side view of the vehicle lifting the drilling/bolting unit apart in an orientation different from the one shown in FIG. 8*b*.

With reference to FIGS. 4 and 5, and in accordance with one aspect of the invention, the unit 10 is provided with means for engaging a utility vehicle to permit use apart from the panline P. In the most preferred embodiment, the means for engaging comprises at least one first pair of receivers 60 for receiving corresponding elongated lifting structures associated with the vehicle V, such as the spaced forks on a shield hauler, fork lift, or like device (see FIG. 9). As illustrated in FIG. 1, the receivers 60 are defined by elongated openings formed in a pair of spaced, tubular shoes 62 (which may be the same as or different from shoes 14) carried by the base 12. In this embodiment, the shoes 62 have a longitudinal axis or direction of elongation generally perpendicular to the conveying direction D of the panline P. The forks F (see FIG. 8*a*) of the vehicle V are thus slidably inserted in the receivers 60 and the entire unit 10 (which may have previously been disassociated with the longwall mining machine) lifted for use apart from the panline P (note action arrow U in FIG. 8*b*) and transported about the mine area. Advantageously, a takeoff from the hydraulic system of the vehicle V may be used to supply power to the onboard motor 44 (and making the necessary connection is facilitated by the onboard mast 46). The unit 10 is thus easily converted for use on the vehicle V, which may of course travel to a desired location in the underground mine remote from the panline P for performing utility drilling or bolting work.

Instead of or in addition to the receivers 60 extending perpendicular to the conveying direction D, the unit 10 may also be adapted for engaging a structure associated with a vehicle V in a direction parallel to the conveying direction. As perhaps best shown in FIGS. 1 and 2, this may be accomplished using engaging means 70 including a first tubular receiver 72 for receiving a first structure associated with a vehicle, such as a fork supported by a forklift or shield hauler. This first receiver 72 may be one elongated structure extending along the base 12 in the conveying direction, or may be two or more separate but substantially aligned structures (only one shown in FIG. 1).

The spacing of the forks on a typical shield hauler or forklift is normally wider than the base 12 of the unit 10, which corresponds in width to the panline P. Providing a second fixed structure (not shown) projecting from the base 12 for receiving the second fork is possible. However, in the more preferred arrangement, the second receiver 74 is comprised of a pair of retractable fork pockets 74*a*, 74*b*. Specifically, a first fork pocket 74*a* is mounted adjacent to one side of the base 12. The mounting is via pivot pin 76, which thus allows the first fork pocket 74*a* to be rotated from a stowed position (as shown in FIG. 1) through an angle of approximately 180° to an operative position (note action arrow J in FIG. 3). A second fork pocket 74*b* at the opposite end of the base 12 is also mounted for pivoting movement by pin 78 from a stowed position through an angle of about 90° to an operative position (note action arrow K). In the operative position, the openings in the two fork pockets 74*a*, 74*b* (which are generally tubular) align in the conveying direction D and are thus ready for receiving the second fork in the normal position (see FIG. 9, noting active positions 74*a*' and 74*b*'). To prevent inadvertent movement to the actuated position during use of the unit 10 on the panline P, the first and second form pockets 74*a*, 74*b* are each preferably held in a stowed position by a releasable latch 80.

Instead of providing tubular receivers 60, 72, 74 adapted for receiving elongated forks or the like, it is also possible to adapt the unit 10 for connection to a loader bucket, to the attachment points for the forks or bucket on an associated vehicle (such as a mine tractor), or to any other type of utility vehicle. For example, a pair of vertically extending channels may be provided on the base, each including a pair of transverse connectors for attachment to each of the four mounting points typically present on a front or bucket loader. A similar attachment structure may be provided for directly engaging the corresponding fork attachment points on a forklift or shield hauler. However, the use of tubular receivers 60, 72, 74 is considered the more efficient and thus preferred approach.

Another unique feature is that the unit 10 can be associated with the panline P, then a removable trapping shoe 16 (or, more particularly, an associated transverse extension, such as a tongue 82) may be associated with the receiver 60 (see FIG. 5) and secured in place (such as by using fasteners, not shown). This arrangement locks the unit 10 to the panline P. In the past, other panline drilling/bolting units required the removal of a section of the panline during mounting, which is obviously a more time consuming and difficult procedure. However, the present arrangement could also work in that situation as well.

The foregoing descriptions of various embodiments of the invention are provided for purposes of illustration, and are not intended to be exhaustive or limiting. Modifications or variations are also possible in light of the above teachings. For example, the drill could be mounted directly to the base 12 instead of on a boom 18, and a corresponding operator's station could be provided. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A drilling or bolting unit for selective use with either a vehicle having a pair of forks or a panline of a face conveyor associated with a longwall miner or mining machine, comprising:

a base adapted for engaging the panline;

a drill head carried by the base;

means for engaging the vehicle associated with the base;

wherein the means for engaging comprises first and second spaced tubular receivers, each receiver comprising a retractable pocket adapted for slidably receiving one of the forks associated with the vehicle in an actuated position.

2. The drill unit according to claim 1, wherein the means for engaging comprises third and fourth spaced receivers oriented in a direction generally perpendicular to the first and second spaced receivers.

3. The drill unit according to claim 1, wherein the pockets in the actuated position are generally aligned with a conveying direction of the panline.

4. The drill unit according to claim 1, wherein the panline includes a shearer or cutter mechanism driven to and fro therealong, and further including a tow bar for associating the base with the shearer or cutter to move the unit to and fro.

5. The unit of claim 1, wherein the tubular receivers are mounted to the base below the drill head, each receiver adapted for receiving one of the forks.

6. In combination, a vehicle and a drilling or bolting unit adapted for engaging a panline of a face conveyor, wherein the unit includes a plurality of receivers, each adapted for receiving a part of the vehicle, whereby the unit may be used as either a panline drilling or bolting unit or a utility drilling or bolting unit with the vehicle apart from the panline;

wherein two tubular receivers are provided for slidably receiving the vehicle part, each having a direction of elongation generally perpendicular to the conveying direction of the panline when associated therewith; and wherein at least one of the receivers includes a pair of pockets movable between a stowed or retracted position and an actuated position for receiving the part of the vehicle.

7. The combination according to claim 6, wherein the plurality of receivers includes four receivers, two of said four receivers having a direction of elongation generally perpendicular to the conveying direction of the panline when associated therewith and the other two of said receivers having a direction of elongation generally parallel to the conveying direction of the panline when associated therewith.

8. The combination according to claim 6, wherein the pockets pivotally mount to a base of the drill unit.

9. A method of drilling in an underground mine having a longwall miner or mining machine including a panline, comprising:

(a) associating a drill unit with the panline;

(b) drilling with the drill unit associated with the panline;

(c) associating the drill unit with a vehicle; and (d) drilling with the drill unit associated with the vehicle.

10. The method according to claim 9, wherein the vehicle includes a pair of forks, and the step of associating the drill unit with the vehicle comprises inserting each fork in a corresponding receiver provided in the drill unit.

11. The method according to claim 10, further including the step of moving each receiver from a stowed position before inserting the corresponding fork.

12. The method according to claim 9, wherein steps (a) and (b) are performed before steps (c) and (d).

13. The method according to claim 9, wherein steps (a) and (b) are repeated after steps (c) and (d) are performed.

14. The method according to claim 9, wherein the step of associating the drill unit with the panline comprises connecting the drill unit to a source of pressurized hydraulic fluid associated with the panline.

15. The method according to claim 9, wherein the step of associating the drill unit with the vehicle comprises connecting the drill unit to a source of pressurized hydraulic fluid associated with the vehicle.

16. The method according to claim 9, the step of using the drill unit in association with the vehicle comprises moving the vehicle to a location remote from the panline.

17. The method according to claim 9, wherein the step of drilling the borehole is preceded by moving the drill unit along the panline in a conveying direction.

18. The method of claim 9, further including the step of using the drill unit to install bolts in a mine passage.

19. A drilling or bolting unit, comprising:

means for engaging a panline of a face conveyor;

means for engaging a vehicle apart from the face conveyor;

wherein the means for engaging the vehicle comprises at least one pair of receivers, each receiver of said pair adapted for receiving an elongated lifting structure associated with the vehicle; and wherein at least one of the receivers comprises a pair of pockets movable between a stowed or retracted and an actuated position.

20. The drilling or bolting unit according to claim 19, wherein the means for engaging the panline comprises a plurality of shoes and a tongue for engaging a trapping shoe associated with the panline.

21. A drilling or bolting unit for use in association with a trapping shoe associated with a guide rail of a panline forming part of a face conveyor having a conveying direction, as well as in connection with a lifting portion of a lifting vehicle, comprising:

a base supporting a drill head for use in drilling boreholes and installing roof bolts in the mine passage;

means for receiving the lifting portion of the lifting vehicle, said means being associated with the base; and a removable retainer for insertion in the receiving means for connecting the unit to the guide rail.

22. The drilling or bolting unit of claim 21, wherein the means for receiving comprises a tubular receiver, and the removable retainer connects with the trapping shoe.

23. A method of associating a drilling or bolting unit with a panline of a face conveyor, comprising:

placing the unit on the panline;

associating a trapping shoe with both the panline and the unit to provide a holddown function by inserting at least a portion of the trapping shoe or an extension thereof within a receiver forming part of the drilling or bolting unit;

drilling using the drilling or bolting unit associated with the panline;

removing the trapping shoe or extension from the receiver; and inserting a fork of a forklift in the receiver.

24. The method of claim 23, further including the step of drilling using the unit associated with the forklift.

* * * * *